US007026780B2

(12) United States Patent
Schröder et al.

(10) Patent No.: US 7,026,780 B2
(45) Date of Patent: Apr. 11, 2006

(54) METHOD FOR STABILIZING THE MOVEMENT OF AN ARTICULATED CHAIN OF A CHAIN BLOCK, ESPECIALLY TO PREVENT THE FORMATION OF A RESONANCE OSCILLATION OF THE CHAIN, AND A CHAIN BLOCK APPARATUS

(75) Inventors: Eberhard Schröder, Halver (DE); Giuliano Persico, Wetter (DE)

(73) Assignee: Demag Cranes & Components GmbH, Wetter (DE)

( * ) Notice: Subject to any disclaimer, the term of this patent is extended or adjusted under 35 U.S.C. 154(b) by 0 days.

(21) Appl. No.: 10/814,902

(22) Filed: Mar. 31, 2004

(65) Prior Publication Data

US 2005/0110451 A1 May 26, 2005

(30) Foreign Application Priority Data

Mar. 31, 2003 (DE) ..... 103 14 724

(51) Int. Cl.
*G05B 5/01* (2006.01)
*B66C 13/06* (2006.01)

(52) U.S. Cl. ..... 318/623; 318/611; 318/1; 318/2; 318/3; 318/4; 318/5; 318/6; 318/7; 318/8; 318/9; 318/10; 318/11; 318/12; 318/13; 318/14; 318/15; 187/292; 212/272; 212/284; 212/275

(58) Field of Classification Search ..... 212/284, 212/272, 274, 275, 276; 318/623, 1–15, 318/611; 187/292
See application file for complete search history.

(56) References Cited

U.S. PATENT DOCUMENTS 3,539,458 A * 11/1970 Blume et al. ..... 205/74
3,918,552 A 11/1975 Kameyama et al. ..... 187/29 R (Continued)

FOREIGN PATENT DOCUMENTS

DE 3933527 C2 2/1992

(Continued)

OTHER PUBLICATIONS

Search Report from corresponding European Application No. EP 04 00 6657, dated Sep. 14, 2004.

(Continued)

*Primary Examiner*—Rina Duda
*Assistant Examiner*—Elias Hiruy
(74) *Attorney, Agent, or Firm*—Van Dyke, Gardner, Linn & Burkhart, LLP

(57) ABSTRACT

The invention concerns a method for stabilizing the motion of an articulated chain of a chain block, especially to prevent the formation of resonance oscillation of the chain, in which an articulated chain is led across a polygonal chain wheel with non-uniform pitch, which is driven by an electric motor.

In order to create a method to prevent the formation of a resonance oscillation of the articulated chain, it is proposed that a periodic and/or stochastic and dampening actuating variable is superimposed on the velocity of the chain wheel (4) and the dampening actuating variable produces a change in the chain velocity so as to prevent a formation of a resonance oscillation.

The chain drive with reduced polygon effect is characterized in that an electronic damper (8) is hooked up in front of the electric motor (2), which produces a control of the electric motor (2) such that a formation of a resonance oscillation of the articulated chain (5) is prevented.

29 Claims, 3 Drawing Sheets

U.S. PATENT DOCUMENTS

| | | | | |
|---|---|---|---|---|
| 3,940,677 | A * | 2/1976 | Morino et al. | 318/685 |
| 3,975,669 | A * | 8/1976 | Tyler | 318/624 |
| 4,181,877 | A * | 1/1980 | Gemp | 388/822 |
| 4,221,301 | A * | 9/1980 | Walerowski | 212/337 |
| 4,383,209 | A * | 5/1983 | Lewis | 318/696 |
| 4,414,497 | A * | 11/1983 | Song | 318/696 |
| 4,520,906 | A * | 6/1985 | Watanabe | 187/292 |
| 4,723,345 | A * | 2/1988 | Pabst | 26/89 |
| 5,377,296 | A | 12/1994 | Greenway et al. | 388/816 |
| 5,694,015 | A * | 12/1997 | Luniewicz et al. | 318/611 |
| 5,719,480 | A * | 2/1998 | Bock et al. | 318/568.11 |
| 5,828,014 | A * | 10/1998 | Goto et al. | 187/292 |
| 5,986,424 | A * | 11/1999 | Nakatsuka et al. | 318/568.22 |
| 6,241,462 | B1 * | 6/2001 | Wannasuphoprasit et al. | 414/800 |
| 6,281,650 | B1 * | 8/2001 | Yutkowitz | 318/561 |
| 6,351,096 | B1 * | 2/2002 | Jang | 318/811 |
| 6,653,804 | B1 * | 11/2003 | Kureck | 318/3 |
| 6,781,340 | B1 * | 8/2004 | Tomita | 318/609 |
| 2001/0013447 | A1 * | 8/2001 | Araki et al. | 187/296 |
| 2002/0144968 | A1 * | 10/2002 | Ruddy | 212/278 |
| 2004/0041528 | A1 * | 3/2004 | Eaton | 318/6 |

FOREIGN PATENT DOCUMENTS

| | | | |
|---|---|---|---|
| DE | 4038981 | A1 | 6/1992 |
| DE | 4111520 | A1 | 10/1992 |
| DE | 69215340 | T2 | 4/1997 |
| DE | 19958709 | A1 | 6/2001 |
| DE | 10120767 | C2 | 3/2003 |
| EP | 0734993 | A2 | 10/1996 |
| EP | 0798488 | A2 | 10/1997 |
| EP | 0903313 | A2 | 3/1999 |
| GB | 2266976 | A | 11/1993 |
| JP | 02018296 | A | 1/1990 |
| WO | 9929032 | | 6/1999 |

OTHER PUBLICATIONS

Search Report from corresponding European Application No. EP 04 00 6657, dated Sep. 14, 2004.

* cited by examiner

METHOD FOR STABILIZING THE MOVEMENT OF AN ARTICULATED CHAIN OF A CHAIN BLOCK, ESPECIALLY TO PREVENT THE FORMATION OF A RESONANCE OSCILLATION OF THE CHAIN, AND A CHAIN BLOCK APPARATUS

BACKGROUND OF THE INVENTION

The invention concerns a method for stabilizing the movement of an articulated chain of a chain block, especially for preventing the formation of a resonance oscillation of the chain, in which an articulated chain is passed across a polygonal chain wheel with non-uniform pitch, which is actuated by an electric motor. The invention also concerns a chain block with a chain taken across a polygonal chain wheel and with an electric motor acting on the chain wheel.

From German patent application DE 1 531 307 A1 there is known a chain block with electric motor actuation. The chain block essentially consists of a chain wheel, actuated by the electric motor, across which is passed the chain, especially a round steel chain, with a means of picking up the load. The chain wheel in this case is configured as a so-called pocket wheel, whose pockets are form-fitted to the links of the chain in order to transmit the lift forces. There is an alternation of one horizontal and one vertical link as they come off the chain wheel. In keeping with the curvature ratio of the chain, the chain wheel has a non-uniform polygonal circumference. This polygonal circumference of the chain wheel means that, as the chain comes off from the chain wheel, the effective radius of the chain wheel changes as a function of angle, and thus the speed of the chain periodically fluctuates accordingly. Thus, the periodic fluctuations even occur when the electric motor has constant speed. This entails an unstable running of the chain, a continual pulsating load on the chain block, and possible troublesome resonance effects.

In order to diminish the fluctuations in the speed at which the chain comes off the chain wheel, it is known how to configure the driven gear arranged at the electric motor and the driving gear of the chain wheel, meshing together, each in a shape deviating from the circular, i.e., non-round, in order to let the speed of the chain wheel pulsate and counteract the above-described polygon effect.

These mechanically operating equalization systems can only result in limited moderating of the run-off speed of a chain of a chain block, since only the low-order mathematical elements of the polygon effect are taken into account. Furthermore, these mechanically operating equalization systems require a large structural expense.

Moreover, from German patent application DE 199 58 709 A1 there is a known method and a device for reducing the polygon effect in the deflection zone of people conveyor systems, especially escalators or moving pavements. The people conveyor systems have an endless plate link chain or Gall's chain, which circulates between two deflection wheels and is taken away rolling at least in the region of its upper side. The plate link chain or Gall's chain and also the deflection wheels are characterized by a uniform pitch. One of the two deflection wheels is driven by an electric drive. In order to reduce the polygon effect occurring as the plate link chain runs around the deflection wheels, a different speed is superimposed on the speed of the deflection wheel. As a result, the electric drive is actuated by a frequency converter so that it turns at a non-constant speed. A regulating device associated with the frequency converter processes the phase position of the deflection wheel and/or the speed of the chain as input signals.

A further modification of the above-described device for reducing the polygon effect in the deflection region of people conveyor systems, especially escalators or moving pavements, is known from German Patent DE 101 20 767 C2. Here, a position-dependent control of the speed of the chain is provided in that the speed fluctuations occurring on the chain segment, when driven by essentially constant rotational frequency, are determined. It is then proposed to accomplish an equalization of the detected speed fluctuations by operating the deflection wheel with non-uniform frequency of rotation, for which a mathematical function is determined that is synchronized only with the angular position of the deflection wheel in the operating state.

The above-described methods and devices for reducing the polygon effect in the deflection region of people conveyor systems pertain to an endless plate link chain. This plate link chain normally has a fixed length, a uniform pitch, and is supported at least in the region of the working side. The polygon effect which occurs is thus dependent on the uniform pitch of the chain wheel. Because the plate link chain is supported at least in the region of the plate link, it experiences a strong dampening. Furthermore, the polygon effect which occurs and which is supposed to be reduced is easier to manage, thanks to the fixed length of the plate link chain.

SUMMARY OF THE INVENTION

Based on this state of the art, the problem underlying the present invention is to optimize a method of stabilizing the running of a link chain of a chain block, especially to prevent the formation of a resonance oscillation of the link chain, and a chain block for this.

This problem is solved by a method for reducing the polygon effect in a chain drive, especially a lifting mechanism, with the features of claim 1, and by a chain drive, especially for a lifting mechanism, by the features indicated in claim 7. The invention is further advantageously configured by the characterizing features of subsidy claims 2 through 6 and 8 through 11, respectively.

According to the invention, in a method for stabilizing the running of an articulated chain of a chain block, especially to prevent the formation of a resonance oscillation of the articulated chain, in which an articulated chain is passed around a polygonal chain wheel with non-uniform pitch, which is driven by an electric motor, an avoidance of resonance oscillations is achieved in that a periodic and/or stochastic and dampening actuating variable is superimposed on the velocity of the chain wheel and the dampening actuating variable brings about a change in the chain velocity, such that formation of a resonance oscillation is prevented. This method prevents the excitation of natural resonances in the region of the lifting motion with varying effective chain length and for different loads.

In order to simulate a dampened kinetic model, the electric motor is actuated via an electronic damper.

In preferred embodiment, the electronic damper is fed a nominal rotary speed of the chain wheel as the first input quantity and an actual angle of the chain wheel as the second input quantity, and a dampening actuating variable is computed in the electronic damper from the two input quantities, which is sent to the electric motor in the form of a dampened rotary speed.

Preferably, as the dampening actuating variable, a dampening force is computed in the electronic damper that is proportional to the amplitude of velocity fluctuations of the load, and which is computed from the actual angle detected by the sensor.

The method in advantageous manner monitors itself, in that the action of a resonance oscillation building up is detected by sensors and the dampening actuating quantity is altered as needed.

The actuation of the electric motor can be simplified when one is handling a constant load on the chain block. In this case, the chain velocity as a function of path distance is superimposed with a programmable velocity pattern in a pilot control for the velocity, to avoid the formation of a resonance oscillation of the articulated chain.

Furthermore, in a chain block with a chain passed around a polygonal chain wheel and with an electric motor acting on the chain wheel, a reduction of the influence of the polygon effect is achieved in that an electronic damper is hooked up in front of the electric motor, which accomplishes a steering of the electric motor such that formation of a resonance oscillation of the articulated chain is prevented.

In advantageous fashion, the electronic damper accomplishes a quiet running of the chain, a smaller pulsating load on the chain block, and hardly any troublesome resonance effects. The electronic damper can be especially advantageously adapted to a changing of the dampening parameters.

Especially advantageously, a nominal rotary speed of the chain wheel is assigned as the first input quantity to the electronic damper and an actual angle of the chain wheel as the second input quantity. Preferably, a sensor in the form of a pulse transmitter for detecting the actual angle in terms of pulses is arranged on the chain wheel, from which at least one angle-synchronized pulse per rotation of the chain wheel is generated. The instantaneous angular position is then determined by interpolation between two consecutive pulses.

The electronic damper is preferably configured as a pilot control element, which is part of an open feedback control circuit. This solution is less expensive compared to a closed feedback circuit with a state controller, which is also possible.

In a preferred embodiment, an empirical optimization of the dampening actuating variable is achieved in that at least one sensor detects the effect of a resonance oscillation that is building up and the dampening actuating variable is altered as necessary.

BRIEF DESCRIPTION OF THE DRAWINGS

The invention shall be described hereafter by means of a drawing, in which.

DETAILED DESCRIPTION OF THE PREFERRED EMBODIMENT

Figure 1:
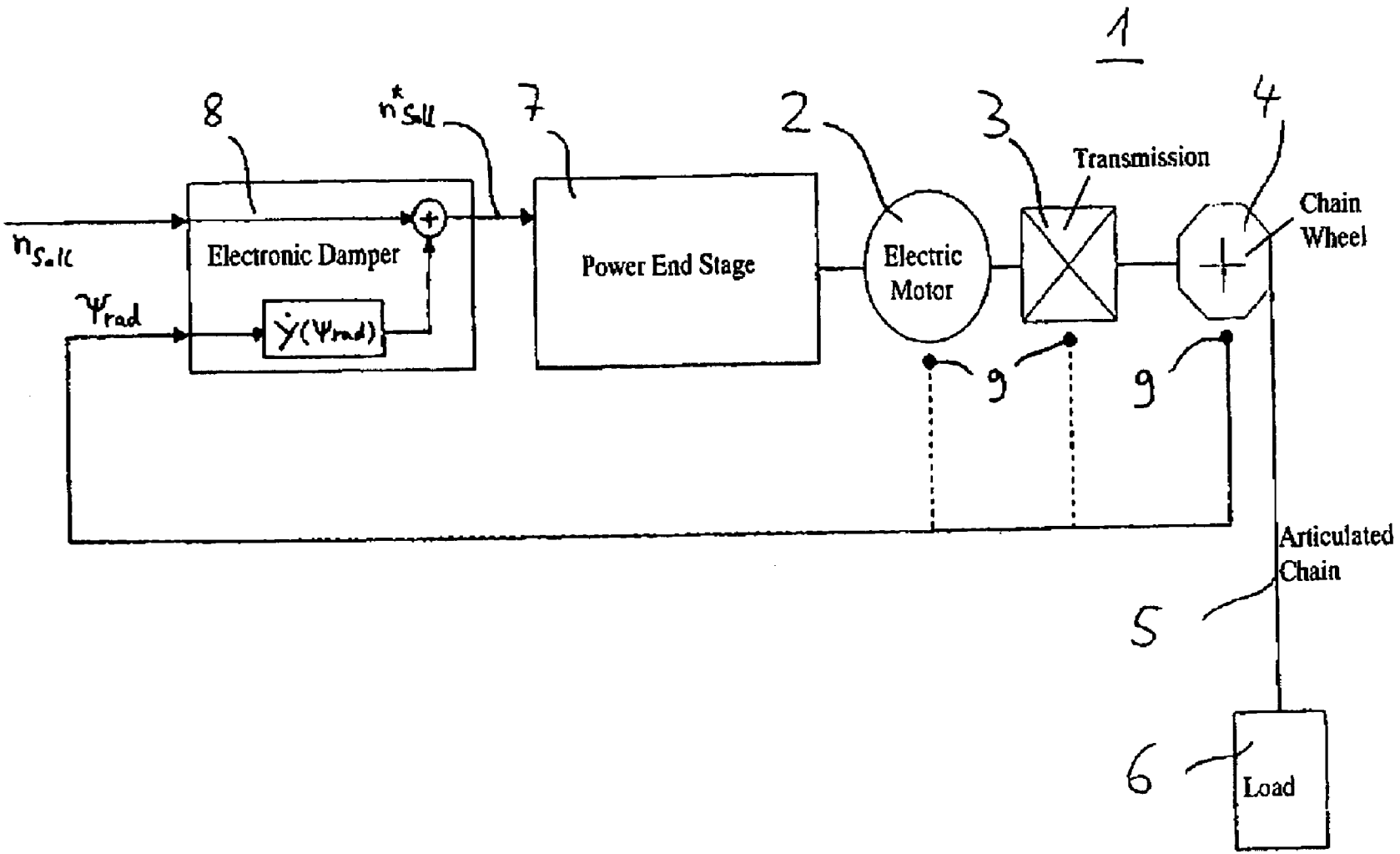
FIG. 1 is a block diagram of a chain block configured according to the invention with an electronic damper.

Referring now to the drawings and the illustrative embodiments depicted therein, FIG. 1 shows a block diagram of a chain drive configured according to the invention in an application for a chain block 1 for lifting and lowering of loads 6, of which one recognizes schematically an electric motor 2, a transmission 3 connected to its take-off shaft (not illustrated), and a chain wheel 4 connected in turn to the latter's take-off shaft (not illustrated). The chain wheel 4 is configured in conventional manner as a pocket wheel with a polygonal circumference and with a non-uniform pitch to accommodate the links of the articulated chain 5, which can swivel relative to each other. Corresponding to the non-uniform pitch of the chain wheel 4, the chain 5 is led with its links around the chain wheel 4 so that the individual links alternately engage vertically and horizontally in succession with the chain wheel 4. The articulated chain 5 is configured as a round steel chain and serves in a typical manner as the carrying element for the load 6 being lifted or lowered, suspended from the lower end of the chain 5.

The freely hanging chain 5, as the carrying element, is not mechanically guided and is practically undamped in relation to sideways deflections. The effective length of the chain 5 varies according to the vertical position of the load 6. Also, the load 6 being manipulated by the chain block 1 can vary during operation. The natural frequency of the chain block 1 is a function of the spring constant of the chain 5, which also is made up of the variable effective length of the chain 5, and the mass of load 6 and chain 5. The variable masses of the loads 6 and the changing effective lengths of the chain 5 produce a band of natural frequencies for the chain block 1. With change in mass and effective length of the chain 5, the natural frequencies of the chain block vary, as does the position of the resonance points along the chain 5. Thus, the chain block 1 represents a structure capable of oscillating with pronounced resonance points. The corresponding mechanical model is an undamped oscillator.

It is known that exciting a chain block 1 in the region of its natural frequencies results in resonance effects. Such resonance effects have the unwanted consequence of producing considerable, predominately sideways deflections of the chain 5, based on the slight dampening of the chain 5.

The frequencies of excitation applicable to the chain block 1 result from the geometry and the rotary speed of the chain wheel 4. Since, as previously described, the chain wheel 4 has a non-uniform pitch, at least two excitation frequencies will be generated, depending on the different geometrically arranged points of engagement for the vertical and horizontal links of the chain 5 in relation to the axis of rotation of the chain wheel 4. These two excitation frequencies are additively superimposed.

The corresponding amplitude of path fluctuation $y_{pol}$ is:

$$y_{pol}=s_1 \sin(e\psi_{rad})+s_2 \sin(2e\psi_{rad})$$

here:

e number of corners of the chain wheel $s_1$ Fourier coefficient $s_2$ Fourier coefficient $\psi_{rad}$ actual angle in radian dimension The corresponding amplitude of velocity fluctuation $\dot{y}_{pol}$ is:

$$\dot{y}_{pol}=\dot{\psi}_{rad}[es_1 \cos(e\psi_{rad})+2es_2 \cos(2e\psi_{rad})]$$

Besides the vertical velocity fluctuations of the unguided articulated chain 5, horizontal velocity fluctuations also occur on a smaller order of magnitude. In the case of plate link chains, on the other hand, only one excitation frequency is generated by the uniform chain wheel 4. These excitation frequencies have the effect that the chain drive 1 gets into the undesirable natural resonance at least at two positions of the usable lifting path of the chain 5. As it passes through the resonance points along the lifting path of the load 6, the load 6 experiences vigorous oscillations. The amplitude of the velocity oscillation of the chain 5 and the resulting oscillation of chain force is greater by a multiple than the velocity and chain force fluctuations produced by the polygon effect. Unlike the oscillations produced by the natural resonance, those of the polygon effect merely result in disturbed operation of the chain block 1.

The non-uniform pitch of the chain wheel 4 causes the fluctuation in the speed at which the chain 5 runs off from the chain wheel 4, also known as the polygon effect, which also results in unquiet running of the chain block 1, but less in relation to the above-described resonance effects.

Based on the awareness that there is practically no dampening in the system of the chain block 1, kinetically considered, the key idea of the present invention is to realize this missing dampening in electronic manner. For this, an electronic damper 8 is hooked up in front of the electric motor 2, furnished with energy by a power end stage 7. The task of the electronic damper 8 is to control or regulate the electric motor 2 via the power end stage 7 in such a way that the polygon effect produced by the chain 5 running off from the chain wheel 4 is altered to such an extent that the excitation of natural resonances is prevented in the region of the lifting path with varying effective chain length and for different loads. A quiet running of the chain 5 and, thus, of the load 6 is the direct consequence.

A suitable actuating variable for the electronic damper 8 can be determined from the following kinetic principles.

The equation of motion for the practically undamped chain block 1 is:

$$m\ddot{y}_m+ky_m=ky_{pol}$$

Here:

m mass of the chain 5 and load 6 k spring constant of the chain 5

$y_m$ amplitude of path fluctuation in relation to the mass m

Compared to a dampened system, which is desirable for the operation of a chain block 1, the customary term c $\dot{y}_m$ in dampened systems is missing. In the present invention, this term is realized by the electronic dampening force $F_D$. The required dampening force $F_D$ is determined in the electronic damper 8 from the amplitude of path fluctuation $y_{pol}$, by a continual sensor detection of the particular angular position $\psi_{rad}$.

The equation of motion for the chain block 1 dampened with the electronic damper 8 is:

$$m\dot{y}_m+ky_m=ky_{pol}+F_D$$

Here:

m mass of the chain 5 and load 6 k spring constant of the chain 5

$y_m$ amplitude of path fluctuation in relation to the mass m

From the solution of the differential equation $\ddot{y}_m$, one can determine the amplitude of velocity fluctuation $\dot{y}_m$ in terms of the mass m:

$$\dot{y}_m=\dot{\psi}_k[V_1es_1\cos(e\psi_{rad}-\phi_1)+V_22es_2\cos(2e\psi_{rad}-\phi_2)]$$

Here:

$$V=\sqrt{\frac{1}{(1-n^2)^2+4D^2n^2}}$$

and $$\phi=\frac{2Dn}{1-n^2}$$

with D being the degree of dampening per Lehr and η as the frequency ratio.

A comparison of the equation for the amplitude of velocity $\dot{y}_{pol}$ in the region of the chain wheel 4 with the equation for the amplitude of velocity $\dot{y}_m$ in the region of the mass m reveals that the dampening actuating variable is a correction signal amplified by $V_1$, $V_2$ and phase-shifted by the $\phi_1$, $\phi_2$. The quantities $V_1$, $V_2$ and $\phi_1$, $\phi_2$ are determined by solving the differential equation. The quantities $V_1$, $V_2$ and $\phi_1$, $\phi_2$ can easily be changed, so that an adjustment is easily possible to allow for dead times, caused by inertia or slack in the chain drive. It is, therefore, easy to optimize the electronic damper 8 to the actual condition of the chain drive 1.

A suboptimal adjustment of the dampening actuating variable means that the resonance oscillation is not sufficiently dampened, or in the worst case may even be stimulated.

The dampening actuating variable thus determined is supplied to the electronic damper and produces a pulsating change in the rotary speed of the chain wheel 4, counteracting the polygon effect. For this, the electronic damper 8 is furnished the nominal rotary speed $n_{Soll}$ as its first input variable. Another input variable is the actual angle $\psi_{rad}$ of the chain wheel 4, which in the present sample embodiment is picked off from the chain wheel 4 or optionally from the electric motor 2 or the transmission 3 by a sensor in the form of a pulse transmitter 9. The pulse transmitter 9 can be optical, magnetic, or inductive, from which at least one angle-synchronized pulse is generated for each rotation of the chain wheel 4. The instantaneous angle position $\psi_{rad}$ is then determined by interpolation between two consecutive pulses. Essentially, it is also possible to determine the polygon effect in terms of other preferably more easily detectable quantities, such as the current of the motor 2, the velocity of the chain, or the chain force.

The electronic damper 8 in the present sample embodiment is configured as a pilot control element, in which the second input quantity, the actual angle $\psi_{rad}$, is converted by a higher-order mathematical function $\dot{y}_m$ ($\psi_{rad}$) into a correction value for the first input variable, the nominal rotary speed $n_{Soll}$ and combined with the nominal rotary speed $n_{Soll}$ at the summation point. As the output quantity, the electronic damper 8 thus furnishes, again, a nominal quantity $n^*_{Soll}$ as the input variable for the power end stage 7.

Basically, it would also be possible to configure the electronic damper 8 as a state controller and thus form a closed feedback control circuit, in contrast to the feedback control circuit with the above-described pilot control element.

In addition, an optimization of the dampening actuating variable is accomplished by feeding back the motor current, the chain velocity, or the chain force to the electronic damper 8. The measurable quantities experience a corresponding superimposed oscillation, due to an incipient resonance oscillation, enabling a conclusion as to a still existing resonance oscillation or residual resonance oscillation. On this basis, one can then optimize the dampening actuating variable $\dot{y}_m$ in the electronic damper 8.

In a simplified embodiment of the electronic damper 8, one can simply modulate the chain velocity, so that the excitation with critical frequency is prevented by changing the velocity. One will thus specifically counteract the establishment of an excitation of the chain block 1 by constantly altering the excitation frequency. It is also possible, in the case of a constant load 6, to superimpose a programmable velocity pattern on the chain velocity by means of a velocity pilot control system, as a function of path, so that resonance oscillations are prevented.

The resonance points can also be established by the above-described feedbacks of the motor current, the chain velocity, or the chain force to the electronic damper 8, or they can be determined as a function of velocity for given load 6 from the system parameters of the chain drive 1, so that it is enough to detect the position at the chain drive in order to determine the approaching of a resonance point.

Figure 2:
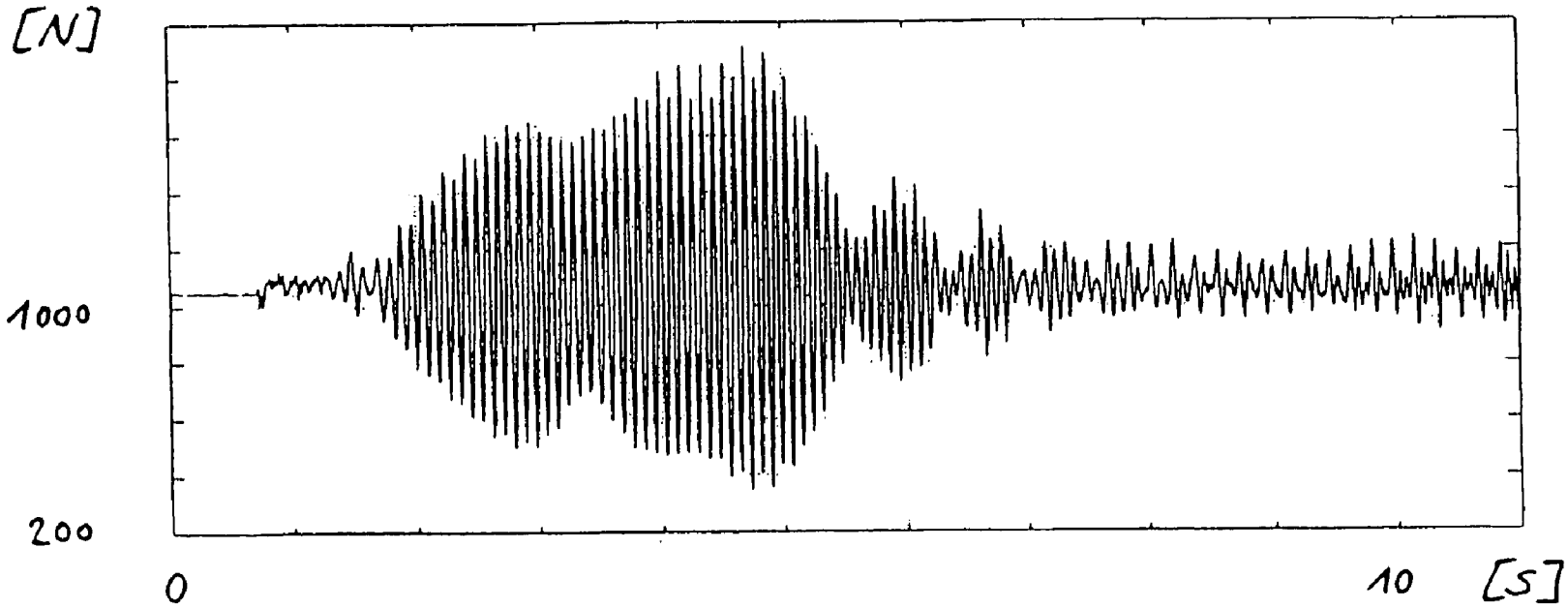
FIG. 2 is a force-time diagram of the polygon-excited chain oscillation of a chain block according to the state of the art.
Figure 3:
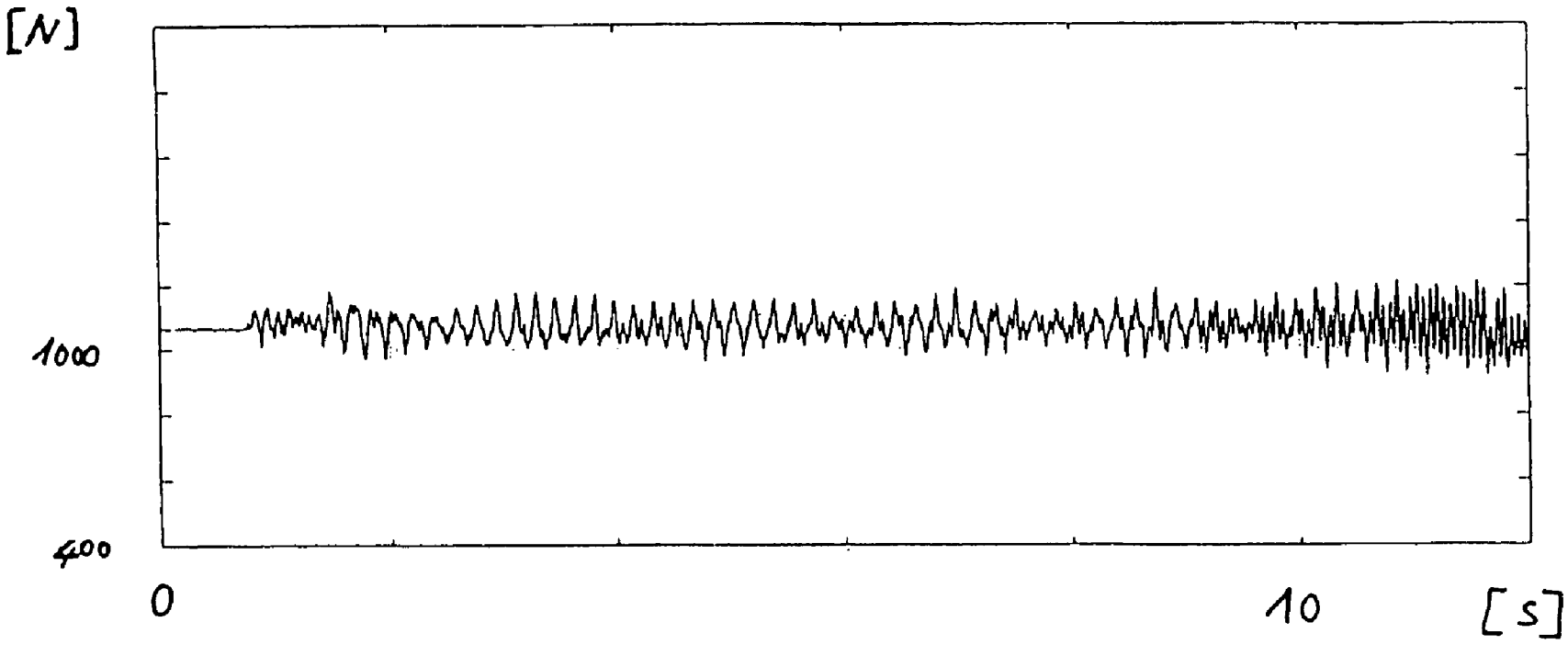
FIG. 3 is a force-time diagram of the polygon-excited chain oscillation of a chain block according to invention.

FIG. 2 shows a force-time diagram of the polygon-excited chain oscillation of a chain block according to the state of the art. In comparison to this, FIG. 3 represents a force-time diagram of the polygon-excited chain oscillation of a chain block according to the invention. As can be seen, over the time from 0 to around 11 sec. represented on the x-axis, during which a trial lifting process of a load is performed, the amplitude of oscillation of the chain force plotted on the y-axis can be reduced from around ±700N to around ±70N by the electronic damper 8 of the invention. In this way, one can achieve a quiet running of the chain and a lower pulsating load on the chain block.

Changes and modifications in the specifically described embodiments can be carried out without departing from the principles of the invention which is intended to be limited only by the scope of the appended claims, as interpreted according to the principles of patent law including the doctrine of equivalents.

The invention claimed is:

1. Method for stabilizing the motion of an articulated chain of a chain block to impede the formation of resonance oscillation of the chain, in which an articulated chain is passed across a polygonal chain wheel with non-uniform pitch, said chain wheel driven by an electric motor, said method comprising:

actuating the electric motor by an electronic damper; and superimposing a dampening actuating variable on the velocity of the chain wheel wherein the dampening actuating variable produces a change in the chain velocity so as to impede formation of a resonance oscillation wherein the dampening actuation variable is at least one chosen from a periodic variable and a stochastic variable, wherein a first input variable and a second input variable are supplied to said electronic damper, and wherein the dampening actuating variable is computed in said electronic damper from the first and second input variables and transferred to the electric motor.

2. The method of claim 1 including providing a velocity pilot control unit and, in event of a constant load being lifted or lowered, superimposing a programmable velocity pattern on the chain velocity with said control unit in order to prevent the formation of a resonance oscillation of the articulated chain.

3. The method of claim 1, wherein a nominal rotary speed ($n_{Soll}$) of the chain wheel is supplied to said electronic damper as the first input variable and an actual angle ($\psi_{rad}$) of the chain wheel as the second input variable, the dampening actuator variable being transferred to the electric motor in the form of a dampened rotary speed ($n^*_{Soll}$).

4. The method of claim 3 including computing a dampening force ($F_D$) as the dampening actuating variable in the electronic damper, said dampening force proportional to the amplitude of velocity fluctuation ($\dot{y}_m$) of the load, and it is calculated from a sensor-detected actual angle ($\psi_{rad}$).

5. The method of claim 4 including providing a sensor and detecting with said sensor the effect of a resonance oscillation building up and altering the dampening actuating variable as a result of the resonance oscillation.

6. The method of claim 5 including providing a velocity pilot control unit and, in event of a constant load being lifted or lowered, superimposing a programmable velocity pattern on the chain velocity with said control unit in order to prevent the formation of a resonance oscillation of the articulated chain.

7. The method of claim 1 including providing a sensor and detecting with said sensor the effect of a resonance oscillation building up and altering the dampening actuating variable as a result of the resonance oscillation.

8. The method of claim 7 including providing a velocity pilot control unit and, in event of a constant load being lifted or lowered, superimposing a programmable velocity pattern on the chain velocity with said control unit in order to prevent the formation of a resonance oscillation of the articulated chain.

9. The method of claim 3 including providing a velocity pilot control unit and, in event of a constant load being lifted or lowered, superimposing a programmable velocity pattern on the chain velocity with said control unit in order to prevent the formation of a resonance oscillation of the articulated chain.

10. The method of claim 4 including providing a velocity pilot control unit and, in event of a constant load being lifted or lowered, superimposing a programmable velocity pattern on the chain velocity with said control unit in order to prevent the formation of a resonance oscillation of the articulated chain.

11. The method of claim 3 including providing a sensor and detecting with said sensor the effect of a resonance oscillation building up and altering the dampening actuating variable as a result of the resonance oscillation.

12. The method of claim 11 including providing a velocity pilot control unit and, in event of a constant load being lifted or lowered, superimposing a programmable velocity pattern on the chain velocity with said control unit in order to prevent the formation of a resonance oscillation of the articulated chain.

13. A chain block, comprising:

a chain led across a polygonal chain wheel with an electric motor acting on the chain wheel; and an electronic damper hooked up in front of the electric motor, said electronic damper controlling said electric motor including superimposing a dampening actuating variable on the velocity of said chain wheel, wherein a first input and a second input are provided to said electronic damper and the dampening actuating variable is computed in said electronic damper from the first and second inputs;

wherein the dampening actuating variable produces a change in the chain velocity so as to impede formation of a resonance oscillation, wherein the dampening actuation variable is at least one chosen from a periodic variable and a stochastic variable;

whereby formation of a resonance oscillation of the articulated chain is impeded.

14. The chain block of claim 13, wherein a nominal rotary speed ($n_{Soll}$) of the chain wheel is provided as the first input to said electronic damper and an actual angle ($\psi_{rad}$) of the chain wheel as the second input to said electronic damper.

15. The chain block of claim 14 including an angle sensor, said angle sensor determining the actual angle ($\psi_{rad}$) of the chain wheel.

16. The chain block of claim 14 including a sensor, said sensor detecting the effect of an incipient resonance oscillation, wherein the dampening actuating variable is altered as a result of the incipient resonance oscillation.

17. The chain block of claim 15 wherein said angle sensor comprises a pulse transmitter, said pulse transmitter determining the actual angle of the wheel in terms of pulses.

18. The chain block of claim 15, wherein said electronic damper is configured as a pilot control element.

19. The chain block of claim 18 including a sensor, said sensor detecting the effect of an incipient resonance oscillation, wherein the dampening actuating variable is altered as a result of the incipient resonance oscillation.

20. The chain block of claim 13 including an angle sensor, said angle sensor determining the actual angle ($\psi_{rad}$) of the chain wheel.

21. The chain block of claim 20, wherein said electronic damper is configured as a pilot control element.

22. The chain block of claim 21 including a sensor, said sensor detecting the effect of an incipient resonance oscillation, wherein the dampening actuating variable is altered as a result of the incipient resonance oscillation.

23. The chain block of claim 13, wherein said electronic damper is configured as a pilot control element.

24. The chain block of claim 23 including a sensor, said sensor detecting the effect of an incipient resonance oscillation, wherein the dampening actuating variable is altered as a result of the incipient resonance oscillation.

25. The chain block of claim 13 including a sensor, said sensor detecting the effect of an incipient resonance oscillation, wherein the dampening actuating variable is altered as a result of the incipient resonance oscillation.

26. Method for stabilizing the motion of an articulated chain of a chain block to impede the formation of resonance oscillation of the chain, in which an articulated chain is passed across a polygonal chain wheel with non-uniform pitch, said chain wheel driven by an electric motor, said method comprising:

actuating the electric motor by an electronic damper;

superimposing a dampening actuating variable on the velocity of the chain wheel wherein the dampening actuating variable produces a change in the chain velocity so as to impede formation of a resonance oscillation wherein the dampening actuation variable is at least one chosen from a periodic variable and a stochastic variable, wherein a nominal rotary speed ($n_{Soll}$) of the chain wheel is supplied to said electronic damper as a first input variable and an actual angle ($\psi_{rad}$) of the chain wheel as a second input variable, wherein the dampening actuating variable is computed in said electronic damper from the first and second input variables, the dampening actuator variable being transferred to the electric motor in the form of a dampened rotary speed ($n^*_{Soll}$); and computing a dampening force ($F_D$) as the dampening actuating variable in the electronic damper, said dampening force proportional to the amplitude of velocity fluctuation ($\dot{y}_m$) of the load, and it is calculated from a sensor-detected actual angle ($\psi_{rad}$).

27. The method of claim 26, including providing a sensor and detecting with said sensor the effect of a resonance oscillation building up and altering the dampening actuating variable as a result of the resonance oscillation.

28. The method of claim 27 including providing a velocity pilot control unit and, in event of a constant load being lifted or lowered, superimposing a programmable velocity pattern on the chain velocity with said control unit in order to prevent the formation of a resonance oscillation of the articulated chain.

29. The method of claim 26 including providing a velocity pilot control until and, in event of a constant load being lifted or lowered, superimposing a programmable velocity pattern on the chain velocity with said control unit in order to prevent the formation of a resonance oscillation of the articulated chain.

* * * * *

UNITED STATES PATENT AND TRADEMARK OFFICE

CERTIFICATE OF CORRECTION

PATENT NO. : 7,026,780 B2 
APPLICATION NO. : 10/814902
DATED : April 11, 2006
INVENTOR(S) : Eberhard Schröder and Giuliano Persico It is certified that error appears in the above-identified patent and that said Letters Patent is hereby corrected as shown below:

Column 5:

Line 48, " $m\dot{y}_m + ky_m = ky_{pol} + F_D$ " should be

-- $m\ddot{y}_m + ky_m = ky_{pol} + F_D$ --.

Column 10:

Claim 29, Line 35, "until" should be --unit--.

Signed and Sealed this

Eighth Day of July, 2008

JON W. DUDAS
*Director of the United States Patent and Trademark Office*

US007026780C1

(12) EX PARTE REEXAMINATION CERTIFICATE (9443rd)

United States Patent

Schröder et al.

(10) Number: US 7,026,780 C1

(45) Certificate Issued: Dec. 17, 2012

(54) METHOD FOR STABILIZING THE MOVEMENT OF AN ARTICULATED CHAIN OF A CHAIN BLOCK, ESPECIALLY TO PREVENT THE FORMATION OF A RESONANCE OSCILLATION OF THE CHAIN, AND A CHAIN BLOCK APPARATUS

(75) Inventors: Eberhard Schröder, Halver (DE); Giuliano Persico, Wetter (DE)

(73) Assignee: Demag Cranes & Components GmbH, Wetter (DE)

Reexamination Request:
No. 90/012,357, Jun. 15, 2012

Reexamination Certificate for:

| | |
|---|---|
| Patent No.: | **7,026,780** |
| Issued: | **Apr. 11, 2006** |
| Appl. No.: | **10/814,902** |
| Filed: | **Mar. 31, 2004** |

Certificate of Correction issued Jul. 8, 2008.

(30) Foreign Application Priority Data

Mar. 31, 2003 (GB) ..... 10314724

(51) Int. Cl.
*G05B 5/01* (2006.01)
*B66C 13/06* (2006.01)

(52) U.S. Cl. ..... 318/623; 187/292; 212/272; 212/275; 212/284; 318/1; 318/10; 318/11; 318/12; 318/13; 318/14; 318/15; 318/2; 318/3; 318/4; 318/5; 318/6; 318/611; 318/7; 318/8; 318/9

(58) Field of Classification Search ..... None
See application file for complete search history.

(56) References Cited

To view the complete listing of prior art documents cited during the proceeding for Reexamination Control Number 90/012,357, please refer to the USPTO's public Patent Application Information Retrieval (PAIR) system under the Display References tab.

*Primary Examiner* — James Menefee

(57) ABSTRACT

The invention concerns a method for stabilizing the motion of an articulated chain of a chain block, especially to prevent the formation of resonance oscillation of the chain, in which an articulated chain is led across a polygonal chain wheel with non-uniform pitch, which is driven by an electric motor.

In order to create a method to prevent the formation of a resonance oscillation of the articulated chain, it is proposed that a periodic and/or stochastic and dampening actuating variable is superimposed on the velocity of the chain wheel (4) and the dampening actuating variable produces a change in the chain velocity so as to prevent a formation of a resonance oscillation.

The chain drive with reduced polygon effect is characterized in that an electronic damper (8) is hooked up in front of the electric motor (2), which produces a control of the electric motor (2) such that a formation of a resonance oscillation of the articulated chain (5) is prevented.

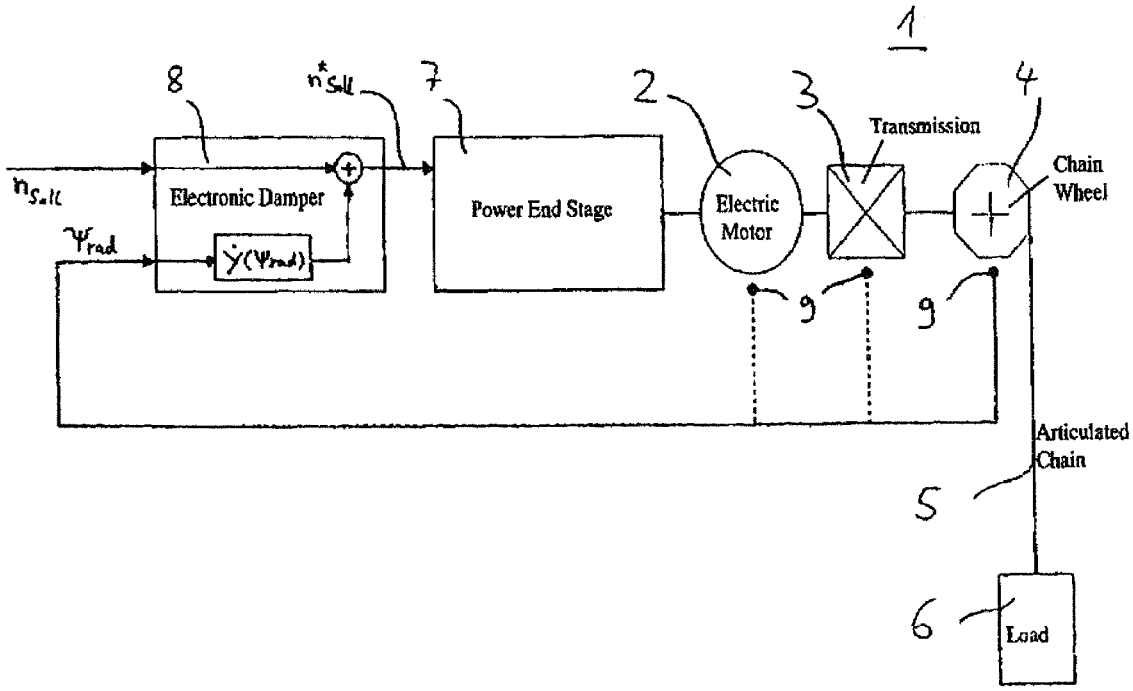

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2, 7-9, 11, 12, 16, 17, 19, 22, 24 and 25 is confirmed.

Claims 1, 3, 13-15, 18, 20, 21 and 23 are cancelled.

Claims 4-6, 10 and 26-29 were not reexamined.

* * * * *